United States Patent [19]

Ashbaugh

[11] Patent Number: 4,462,715

[45] Date of Patent: Jul. 31, 1984

[54] SYSTEM FOR THE ONE-STEP DEWATERING OF A TRENCH AND THE CONSTRUCTION OF A PIPELINE BED

[76] Inventor: Duwane R. Ashbaugh, Box 16, Six Lakes, Mich. 48886

[21] Appl. No.: 307,159

[22] Filed: Sep. 30, 1981

[51] Int. Cl.[3] ..... E02B 11/00; F16L 1/02; F16L 3/00

[52] U.S. Cl. ..... 405/157; 405/50; 405/179

[58] Field of Search ..... 405/38, 50, 154, 157, 405/179, 270; 404/96, 105

[56] References Cited

U.S. PATENT DOCUMENTS

| | | | |
|---|---|---|---|
| 1,286,666 | 12/1918 | Layne | 405/50 X |
| 3,664,137 | 5/1972 | Lett | 405/179 X |
| 3,833,071 | 9/1974 | Koosman et al. | 405/50 |
| 3,952,529 | 4/1976 | Lefever | 405/154 X |
| 4,068,488 | 1/1978 | Ball | 405/154 X |
| 4,289,424 | 9/1981 | Shefbuch et al. | 405/179 |
| 4,319,859 | 3/1982 | Wise | 404/96 X |

*Primary Examiner*—Cornelius J. Husar
*Assistant Examiner*—Nancy J. Stodola
*Attorney, Agent, or Firm*—Learman & McCulloch

[57] ABSTRACT

A system for laying a pipeline receiving stone bed in the bottom of a trench into which water may have seeped and there is accordingly some erosion of the trench side walls comprising:moving a stone-filled box along the trench in increments as the trench is dug out ahead of the box while moving earth which has collapsed into the trench forwardly along the trench; and simultaneously dispensing stone out the rear end of the box to form a bed which shores up the sides of the trench and pumping water out of the next section of the trench to receive the bed.

8 Claims, 5 Drawing Figures

SYSTEM FOR THE ONE-STEP DEWATERING OF A TRENCH AND THE CONSTRUCTION OF A PIPELINE BED

BACKGROUND OF THE INVENTION

This invention relates to the construction of pipelines, i.e., sewer and water pipelines of the type used by municipalities, for example, and particularly to systems for laying stone beds in the bottom of trenches which are frequently dug in flowable, sandy soil which includes sand and water bearing strata where flooding-in and cascading-in of the sides of the trench is an ever-present problem. Typically, if wellpoint-pumping does not sufficiently dewater the area in which the trench is to be dug, stone is manually spread in the bottom of such trenches after they are dug, and the procedure is arduous, time-consuming and expensive. The stone beds formed in the bottom of the trench by such methods have resulted in non-uniform beds, in some places excessively thick and therefore unduly costly, and in other places insufficient to properly support the pipeline. Moreover, several crews of workmen are required under present practice to first do the dewatering and then afterward to lay the stone bed and pipeline.

One of the prime objects of the present invention is to provide a stone-laying box capable of simultaneously laying a stone bed with higher level packed side walls which shore up the bottom side walls of the trench, while at the same time, pumping water out of the trench and pushing cascaded sandy ground which has fallen into the trench ahead of the box so that it can be removed by the backhoe or other trenching vehicle being used to dig the trench, and to move the trench box along the trench incrementally while the trench is being dug.

A further object of the invention is to lay a pipe-accommodating bed of the character described which is packed into a predesignated contour by the very act of the stone box being pushed along the bottom of the trench.

Still another object of the invention is to provide a pipe bed laying system adequate to support the pipeline.

Another object of the invention is to provide a pipe bed laying system which operates expeditiously and efficiently to accomplish the job in a far more satisfactory and economical manner than heretofore has been possible.

SUMMARY OF THE INVENTION

The system entails the use of a dewatering box, within which a pump is mounted to permit water to be pumped out of the box while the stone in the box is being ejected in the form of a U-shaped pipeline supporting bed, having side walls of increased height to shore up the side walls of the trench. The bed-laying function is accomplished when the box is pushed forwardly by the trenching vehicle without the need for motive power which would add considerably to the cost of the system, and introduce complexities.

Other objects and advantages of the invention will be pointed out specifically or will become apparent from the following description when it is considered in conjunction with the appended claims and the accompanying drawings.

IN THE DRAWINGS

SPECIFIC DESCRIPTION OF A PREFERRED EMBODIMENT

As indicated, the present invention comprehends a system for laying a uniform bed of particulate material such as small stone in the bottom of a trench which is to receive a pipeline. Typically, trenches of the character involved in practicing this invention may be ten to fourteen feet in depth to accommodate a pipeline which will have joined-together leak-proof sections on the order of perhaps eight feet in diameter. Some trenches of this type are dug in sandy soil where the water table is relatively high. It is common for the sides of the trench near the bottom to cave in, and for more water to collect in the trench and cause this problem. In digging inground locations of this character, it has been common practice to use well points to remove the water and reduce the water table prior to even attempting to dig the trench.

Figure 1:
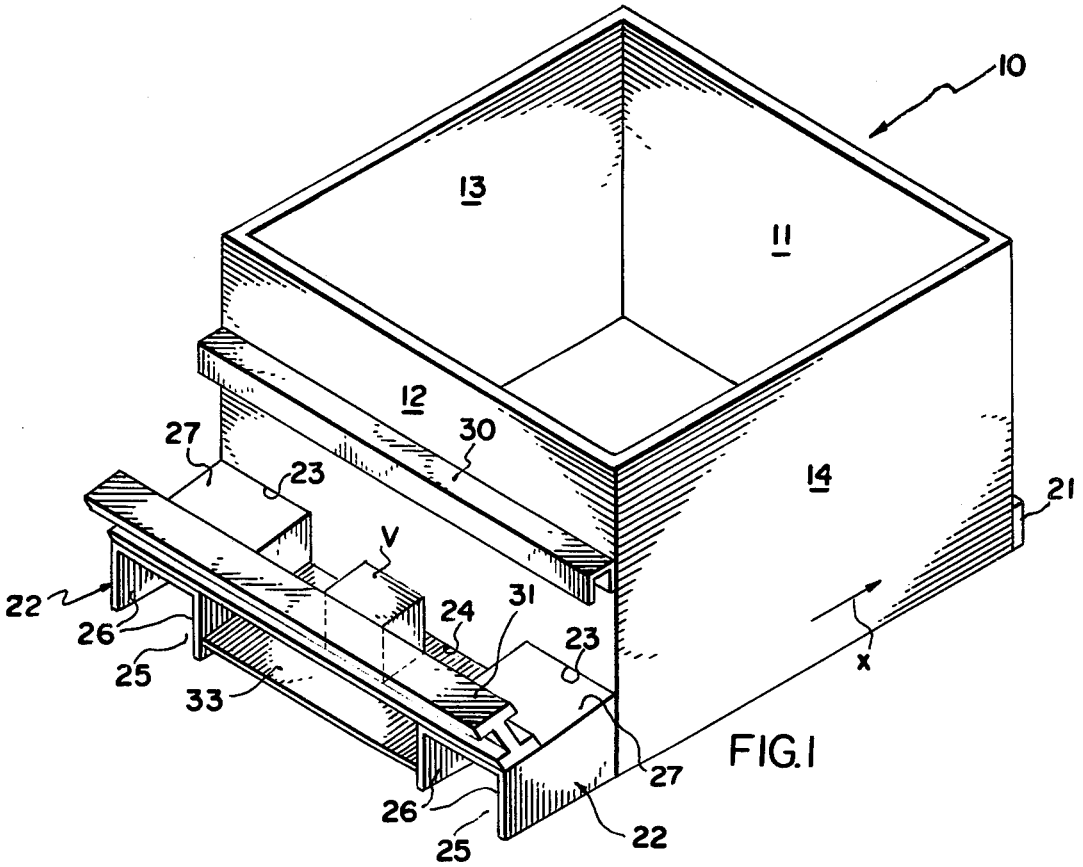
FIG. 1 is a perspective elevational view illustrating the construction of the dewatering box.
Figure 2:
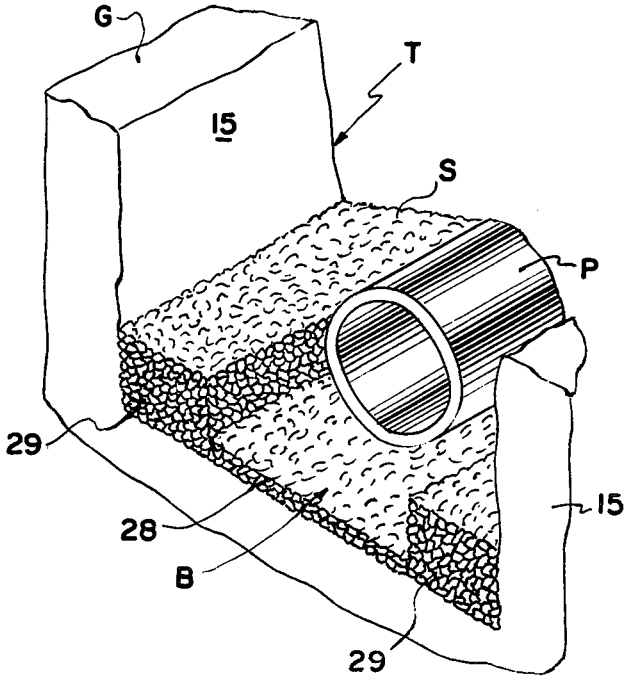
FIG. 2 is a sectional, perspective view showing the stone bed which is laid in the bottom of the trench following the procedure to be described.
Figure 3:
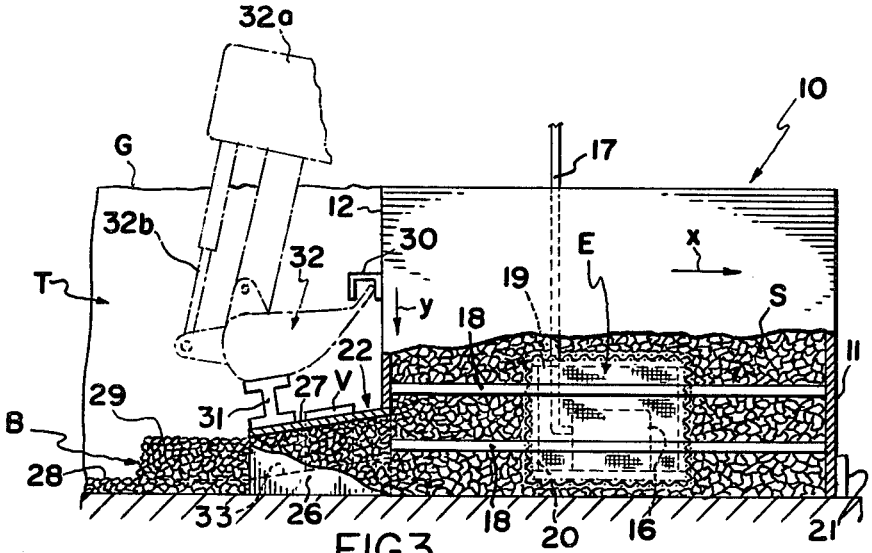
FIG. 3 is a reduced size, partly sectional, side elevational view illustrating the manner in which the bed is laid.

Referring now more particularly to the accompanying drawings, and particularly to FIG. 2, a U-shaped trench, generally designated T, is shown as dug in ground G of the character indicated, and at B is shown a stone bed of the character laid by the system to receive the pipeline P. The system involves the lowering of a dewatering box, generally designated 10 into the trench T, into a portion of the trench which already has been dug by a backhoe. The box 10, which is filled with the stone S, includes front and rear walls 11 and 12, respectively, and side walls 13 and 14 which substantially fit the width of the trench being dug. Thus, side walls 13 and 14 of the box will be substantially in engagement with the side walls 15 of the trench T. The top of the trench box 10 is open so that the supply of stone S in the box 10 can be replenished periodically when necessary, and, as indicated in FIG. 3, the bottom of the box is also open.

Supported within the interior of box 10, near the lower end thereof, is a rectangular screen enclosure E which houses a preferably hydraulic motor-powered water pump, the motor and pump assembly being shown schematically at 16, and being of the type wherein the pump sucks water in through a mesh of screen in its bottom. The outflow pipe for the motor-pump assembly 16 (which could be electrically or otherwise powdered also), is shown at 17 as comprising a rigid conduit which leads out of the trench T and connects with a flexible conduit for removing water from the general area of the trench T. Horizontal rails 18, which span the front and rear walls 11 and 12 of the box 10, support the enclosure E at a spaced distance above the lower end of front wall 11, i.e. normally an inch, so that the pump removes water and does not tend to suck up sand from the bottom of the trench. Normally, the enclosure E is thus surrounded by stone S which is too large to pass though the openings in the screen enclosure which encloses the motor-pump assembly 16. The enclosure E, of course, includes horizontal and vertical framing members 19 and 20, which support the weight of the motor-pump assembly 16 via support rails 18, without interfering with the function of the pump.

In practice, the dewatering box 10 is periodically moved in the direction x along the bottom of the trench, and a scraper blade 21 clears out earth which has fallen into the bottom of the trench T as the box 10 is moved along.

Provided on the rear wall 12 are a pair of box-like dispensing members 22 at the extreme sides of the box. To receive the inversely U-shaped housings 22, the sides of the rear wall 12 of the box 10 are cut away, as at 23, and the central portion of rear wall 12 is also cut away, but at a lower level as shown at 24, level 24 being disposed a predetermined distance above the level of the lower edge of blade 21 and enclosure E.

Figure 4:
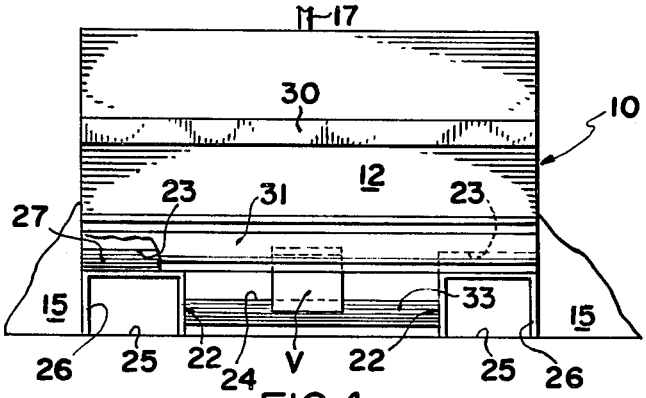
FIG. 4 is a front elevational view thereof.
Figure 5:
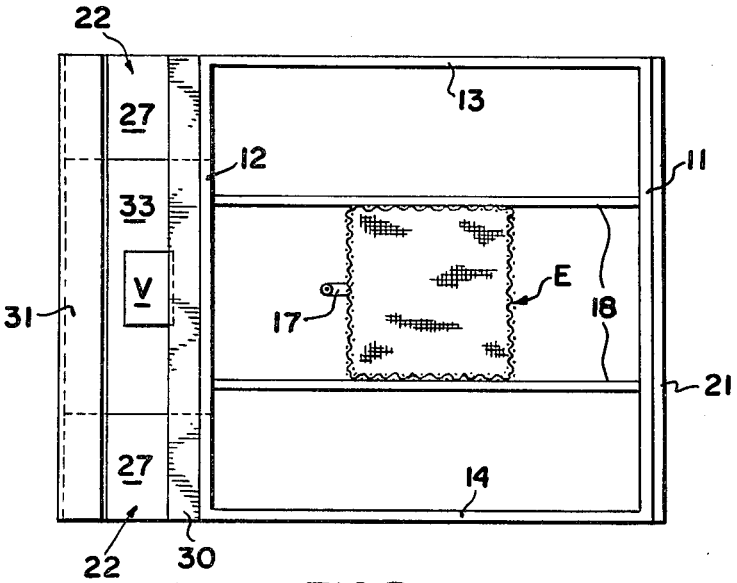
FIG. 5 is a top plan view thereof.

As indicated particularly in FIG. 4, the housings 22 are open at their bottom ends at 25, and comprise side walls 26 spanned by a downwardly and rearwardly sloping roof section 27. At a lower level 24, the roof 33 for the mid-portion also extends downwardly and outwardly. It is important that the roof sections 27 and 33 incline in the direction indicated in order to densly pack the stone which is dispensed when the box 10 is moved in the direction x. The bed B includes a central pipeline supporting section 28, and end sections 29 of increased height (i.e., quadruple), which are formed by the housing 22, the packed stone bed side walls 29 serving to shore up the lower portions of the side walls 15 of the trench T in the manner indicated.

Provided on the rear wall 12 of the box 10 above the sections 22, is a channel beam 30 and a suitable beam, such as a railroad tie 31 spans the housings 22, and it is this structure that is engaged by the bucket 32 of the backhoe. When it is desired to move the box 10 in the direction x, pressure exerted by the piston rod of a hydraulic cylinder **32*b* is exerting a downward force component y on the box 10. A motor driven vibrator V can also be mounted on the roof plate 33 spanning housings 27** to enhance the packing action.

THE OPERATION

In operation, the backhoe vehicle chassis is disposed on its crawler treads in the trench T to the right of the stone box 10 in FIG. 3, and is engaged in continuing to dig the trench T to the right of its location. When it has dug out a designated length of trench, the backhoe boom **32*a* is swung upwardly through an arc to a position in which the shovel 32 is disposed approximately in the position in which it is shown in FIG. 3. With bucket 32 exerting a push on box 10 in the direction x, and at the same time exerting a downward component of force in the direction y, box 10 is moved a box length to the right in FIG. 3. When this occurs, stone S flows out through opening 24 and the open ends of inversely U-shaped box-like members 22 to form a bed B which has portions 28 and 29. The sloped roof sections 27 and 33 tend to pack the stone in sections 28 and 29 and the vibrator V enhances this packing action in the sense that it tends to densify sections 28 and 29**.

As the box 10 is being moved to the right, water from the next section of the trench T, which is to receive the bed B, is continuously being pumped from that portion of trench T by pump assembly 16 via rigid pipe 17, and scraper 21 is continuously moving any earth which has fallen into the trench T to the right along the trench T. This is possible because of the downward, as well as rightward, force exerted by the backhoe shovel 32.

A conventional safety trench box, in which the pipe layers are accommodated can be releasably attached to the rear end of the dewatering box described.

While one embodiment of the invention has been described in detail, it will be apparent to those skilled in the art that the disclosed embodiment may be modified. Therefore, the foregoing description is to be considered exemplary, rather than limiting, and the true scope of the invention is that defined in the following claims.

I claim:

1. A method of forming stone or like particulate material beds for receiving pipelines in the bottom of a trench comprising: digging a trench having side walls and a bottom in ground in which there is ground water at the level of the trench bottom; lowering a generally rectangular enclosure surrounding an interior, having open upper and lower ends, and having front, rear, and side walls, into the trench and supplying stone or the like to the interior of the enclosure; then from within the enclosure pumping ground water from the portion of the trench bottom covered by the enclosure while the enclosure is disposed in the trench; the rear wall of the enclosure having a stone dispensing opening; moving the enclosure forwardly an increment to cause the stone or the like to be dispensed in completed bed form through said opening from the rear of the enclosure; exerting a downward component of force on the enclosure during the time the enclosure is moved in a forward direction to wedge portions of the stone or the like forming the bed into place as the enclosure is moved in the forward direction, forming a U-shaped bed when the enclosure is moved in he forward direction with the bed having higher side portions to shore up the trench; and laying the pipeline in the bed.

2. The method of clam 1 in which earth collapsed into the trench ahead of the enclosure is simultaneously moved forwardly by the enclosure, as the enclosure is moved in its foward increment, and while pumping is occurring.

3. The method of claim 1 wherein the enclosure is vibrated at its rear wall to tend to densify the stone or the like being emitted from the enclosure to form the bed, the vibrator exerting principally a vertical component of motion to exert a densifying effect which enhances wedging of the stone or the like into place.

4. In apparatus for laying a stone or other particulate material bed which shores up the sides of a trench with side walls and a bottom wall, dug in ground having ground water at the level of the trench bottom wall, while accommodating a pipeline at a support level, and which includes a dewatering box with an interior for accommodating a supply of stone or like material, having four sides, the box having open upper and lower ends, and one of the sides of said box being an upstanding rear wall formed with lower cutout portions permitting the dispensing of stone or like material in the form of a bed, another side of the box being the front wall of the box and inluding a portion functioning as a blade having a lower edge which moves earth along the trench when the box is moved forwardly along the trench; a pump assembly supported within the box at a level spaced above the lower edge of said blade for movement with the box, and having a water eject pipe portion leading up out of the open top of the box.

5. The apparatus of claim 4 in which rearwardly projecting housings having roof portions are provided on the rear wall of the box communicating with the interior of the box, and the rear wall of the box includes a mid-roof at a level raised above the bottom of the box, but below the said roof portions of the housings.

6. The system defined in claim 5 in which the mid-roof and roof portions of the rearwardly projecing housings slope downwardly and rearwardly to wedge stone dispensed from the box into densified portions which can support a pipeline and shore up the lower sides of the trench.

7. In apparatus for laying a stone or like material bed which shores up the sides of a trench, with side walls and a bottom wall, dug in ground having ground water at the level of the trench bottom wall, while accommodating a pipeline on the bed, and which includes a box having four sides enclosing an interior for accommodating a supply of stone or like material, the box having open upper and lower ends, one of said sides being an upstanding rear wall having a lower edge formed by cutout portions permitting the dispensing of stone or the like from the interior of the box in the form of a bed, the cutout portions including side cut out openings and an intermediate cut out opening intermediate the side cut out openings, inversely U-shaped dispensing housings projecting rearwardly from the box to lead from the side cut out openings; and a roof projecting rearwardly from the intermediate cut out portion joined to said housing; another side of the box comprising an upstanding front wall having a lower edge functioning as a blade which moves earth along the trench when the box is moved along the trench, and the said roof for the intermediate cut out portion being at a raised spaced level above the said lower edge.

8. The system of claim 7 wherein the upper walls of the housings and the said roof slope rearwardly and downwardly to wedge the stone or the like dispensed from the box into the bed being formed.

* * * * *